US011624546B2

(12) United States Patent
Caglin et al.

(10) Patent No.: US 11,624,546 B2
(45) Date of Patent: Apr. 11, 2023

(54) COOLING DEVICE HAVING AT LEAST TWO STORAGE COMPARTMENTS

(71) Applicant: BSH Hausgeraete GmbH, Munich (DE)

(72) Inventors: Muharrem Uemit Caglin, Istanbul (TR); Tezcan Cetin, Tekirdag (TR); Ercan Engin, Tekirdag (TR); Ibrahim Tugrul Soenmez, Tekirdag (TR)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 17/493,079

(22) Filed: Oct. 4, 2021

(65) Prior Publication Data

US 2022/0196316 A1 Jun. 23, 2022

(30) Foreign Application Priority Data

Dec. 23, 2020 (TR) ..... 2020/21383

(51) Int. Cl.
*F25D 23/02* (2006.01)
*E05D 15/48* (2006.01)

(52) U.S. Cl.
CPC ..... *F25D 23/02* (2013.01); *E05D 15/48* (2013.01); *E05D 2015/485* (2013.01); *E05Y 2900/31* (2013.01)

(58) Field of Classification Search
CPC ..... F25D 23/02; F25D 13/02; F25D 25/025; E05D 15/48; E05D 2015/485; E05Y 2900/31
See application file for complete search history.

(56) References Cited

U.S. PATENT DOCUMENTS

| | | | | |
|---|---|---|---|---|
| 9,885,202 | B2 * | 2/2018 | Laible | E05C 19/161 |
| 2005/0138955 | A1 * | 6/2005 | Okuda | F25D 25/02 312/401 |
| 2012/0099255 | A1 * | 4/2012 | Lee | F25D 25/025 361/679.01 |
| 2017/0115050 | A1 * | 4/2017 | Ramm | F25D 25/025 |
| 2017/0115051 | A1 * | 4/2017 | Ramm | F25D 25/025 |
| 2017/0122653 | A1 * | 5/2017 | Cizik | F25D 17/042 |
| 2017/0167779 | A1 * | 6/2017 | Haeberle | F25D 25/025 |
| 2017/0176088 | A1 * | 6/2017 | Richards | F25D 23/028 |
| 2017/0191736 | A1 * | 7/2017 | Fleig | F25D 23/028 |
| 2017/0299253 | A1 * | 10/2017 | Wang | F25D 23/066 |
| 2018/0142941 | A1 * | 5/2018 | Arslankiray | F25D 23/028 |
| 2018/0149417 | A1 * | 5/2018 | Caglin | F25D 23/069 |
| 2018/0266754 | A1 * | 9/2018 | Hottmann | F25D 25/025 |
| 2019/0308393 | A1 * | 10/2019 | Allard | F25D 23/02 |
| 2020/0355021 | A1 * | 11/2020 | Dallman | F25D 23/02 |
| 2021/0254888 | A1 * | 8/2021 | Cremaschi | G07F 9/023 |
| 2022/0260305 | A1 * | 8/2022 | Hosamani | F25D 23/063 |

FOREIGN PATENT DOCUMENTS

EP 2182308 A2 5/2010

* cited by examiner

*Primary Examiner* — Hanh V Tran
(74) *Attorney, Agent, or Firm* — Laurence A. Greenberg; Werner H. Stemer; Ralph E. Locher

(57) ABSTRACT

A cooling device includes a body and at least two storage compartments having at least one insulation wall therebetween. At least one door is associated with a flank part of the body facing the door. Accordingly, the door is configured in such a manner as to close the inlet of the at least two storage compartments.

12 Claims, 8 Drawing Sheets

COOLING DEVICE HAVING AT LEAST TWO STORAGE COMPARTMENTS

CROSS-REFERENCE TO RELATED APPLICATION

This application claims the priority, under 35 U.S.C. § 119, of Turkish Patent Application TR 2020/21383, filed Dec. 23, 2020; the prior application is herewith incorporated by reference in its entirety.

FIELD AND BACKGROUND OF THE INVENTION

The present invention relates to a cooling device. The cooling device includes a body having at least two storage compartments and at least one insulation wall therebetween, and at least one door is associated with a flank part of the body.

Cooling devices are used for keeping foods at suitable temperatures. The increase in the expectations of consumers and food variety lead to the need for keeping the foods, placed into cooling devices, at different temperatures. In order to meet that need, the body of the cooling device is separated into compartments so as to have a plurality of storage compartments. A door is provided for closing each of the storage compartments. In order for the doors to be able to operate if the storage compartments are provided side by side, the insulation wall, provided between the storage compartments, should be substantially thick.

As can be seen in FIGS. 8 and 9, in the prior art, there is a separate door for each storage compartment. Gaskets are provided on the doors to provide heat insulation between the doors and the body. There is also a decorative panel on each door.

In European Patent Application EP 2 182 308, a refrigerator having a plurality of independent compartments is disclosed. The refrigerator includes multiple independent compartments, of which at least one is devised to preserve food and beverages, or any other type of organic matter, at room temperature (like a cooling cabinet and wine cellar compartment), which is the most distinctive element of those refrigerators. Those refrigerators may contain from one or two up to three or four (or even more) compartments, all of them being independent spaces that can be opened and closed with doors, or in the form of a drawer. Furthermore, the fact that there are multiple independent compartments allows a greater energy optimization. Those refrigerators are also distinguished by their avant-garde configurations unlike traditional refrigerators.

SUMMARY OF THE INVENTION

It is accordingly an object of the invention to provide a cooling device having at least two storage compartments, which overcomes the hereinafore-mentioned disadvantages of the heretofore-known devices of this general type, in which inner volumes of storage compartments are increased and in which production costs are decreased.

With the foregoing and other objects in view there is provided, in accordance with the invention, a cooling device having a body and at least two storage compartments with at least one insulation wall therebetween, and at least one door associated with a flank part of the body facing the door. Accordingly, the door is configured in such a manner as to close the inlets of the at least two storage compartments. It thus becomes possible to decrease the insulation wall thickness provided between the storage compartments.

In another possible embodiment of the invention, the door has at least one gasket in order to rest at the flank part in a manner encircling the storage compartment. Thus, thermal insulation is provided between the door and the body.

In a further possible embodiment of the invention, the gaskets are provided on an inner liner of the door facing the flank part. Thus, the gaskets are connected to the door.

In an added possible embodiment of the invention, the gaskets are configured to be attached to at least one gasket channel provided on the inner liner. Thus, the connections of the gaskets to the door are facilitated.

In an additional possible embodiment of the invention, the door includes at least two bosses or bossings provided in a manner extending inwards toward the storage compartment when the door is closed. Thus, the thickness of the door and the thermal insulation feature are increased accordingly.

In another possible embodiment of the invention, the bosses are provided in an integrated manner on the inner liner. Thus, the production of bosses is facilitated.

In a further possible embodiment of the invention, each of the bosses is provided in a compliant or adapted manner to a shape of the respective storage compartment. Thus, the thickness of the door and the thermal insulation feature are increased accordingly.

In an added possible embodiment of the invention, the boss is substantially close to the dimension of the inlet of the storage compartment. Thus, the thermal insulation feature are increased.

In an additional possible embodiment of the invention, the door includes a decorative panel provided in a manner covering at least two storage compartments. Thus, the assembly of the decorative panel is facilitated.

In another possible embodiment of the invention, the door includes at least two pull-out brackets in a manner connected to the side walls of the body. Thus, the assembly of the pull-out brackets are facilitated and total cost is decreased.

In a concomitant possible embodiment of the invention, the door includes one or more pull-out brackets connected to the insulation wall. This allows large and heavy doors to be lifted.

Other features which are considered as characteristic for the invention are set forth in the appended claims.

Although the invention is illustrated and described herein as embodied in a cooling device having at least two storage compartments, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

In this detailed description, a cooling device 10 according to the invention is explained with reference to examples without forming any restrictive effect and only in order to make the subject more understandable.

Figure 1:
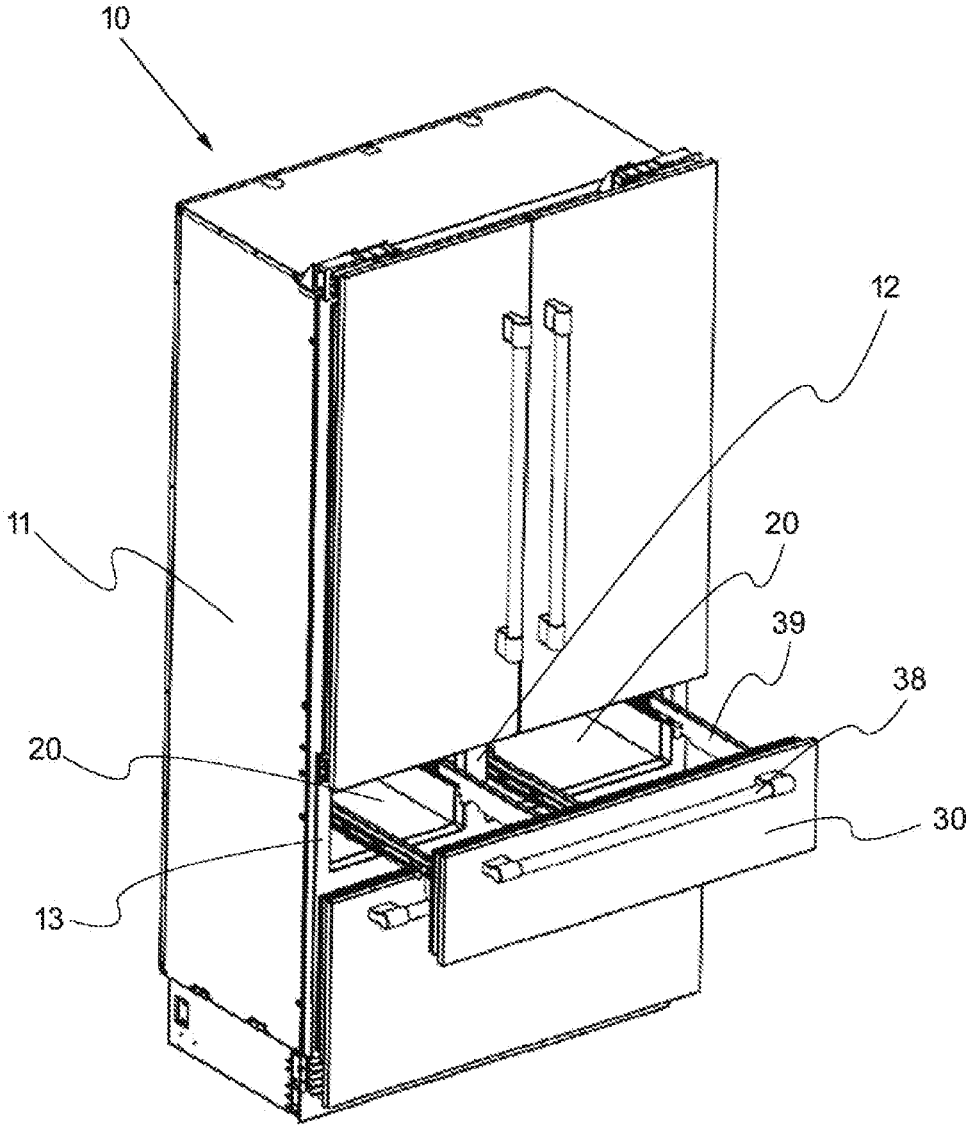
FIG. 1 is a representative, diagrammatic, perspective view of the cooling device according to the invention.
Figure 2:
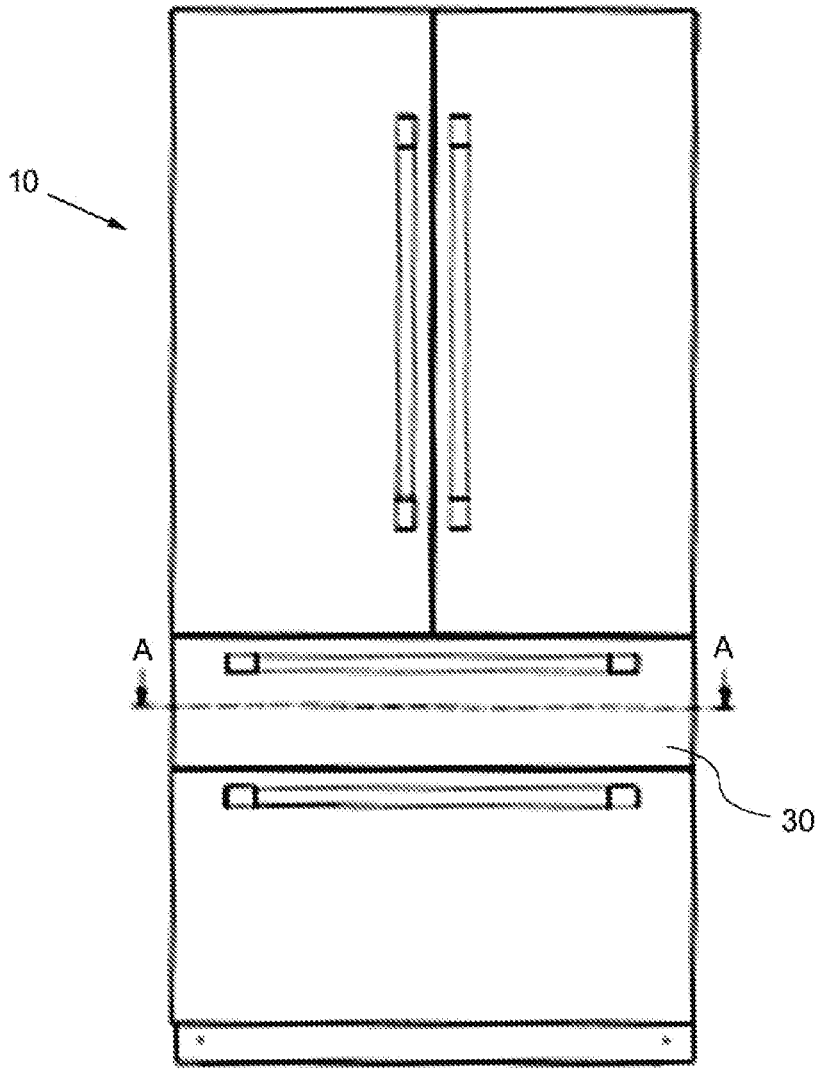
FIG. 2 is a representative, front-elevational view of the cooling device according to the invention.

Referring now to the figures of the drawings in detail and first, particularly, to FIGS. 1 and 2 thereof, there is seen a cooling device 10 according to the invention which has a body 11. The body 11 is provided so as to have thermal insulation. There are at least two storage compartments 20 for providing stored foods in the body 11. The storage compartments 20 can be at different temperatures. There is at least one insulation wall 12 provided between the storage compartments 20. In a possible embodiment of the present invention, the storage compartments 20 are provided side by side and are separated from each other by the insulation wall 12. A door 30 connected to the body 11 is provided in such a manner as to cover both of the storage compartments 20 together.

Figure 3:
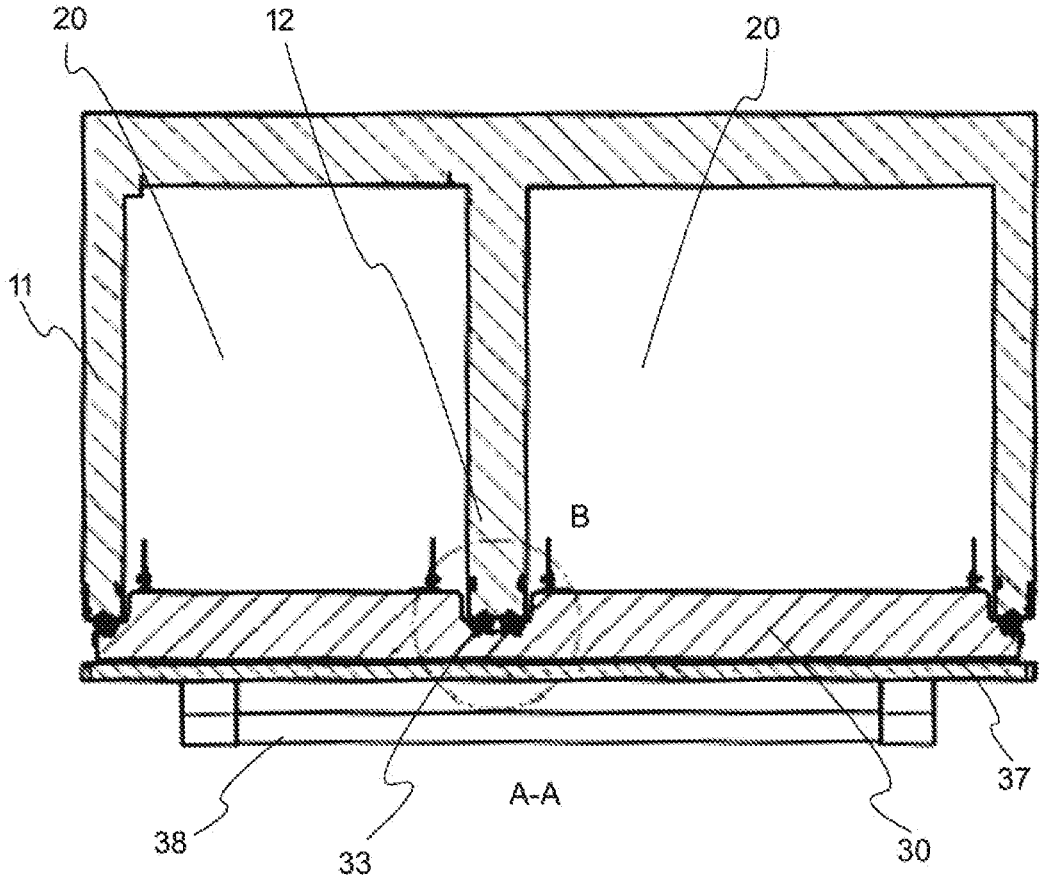
FIG. 3 is a representative, cross-sectional view of the cooling device according to the invention, which is taken along the line A-A of FIG. 2, in the direction of the arrows.

In FIG. 3, a representative cross-sectional view of the cooling device according to the invention 10 is shown. Accordingly, the door 30 closes two storage compartments 20 which are positioned side by side.

Figure 4:
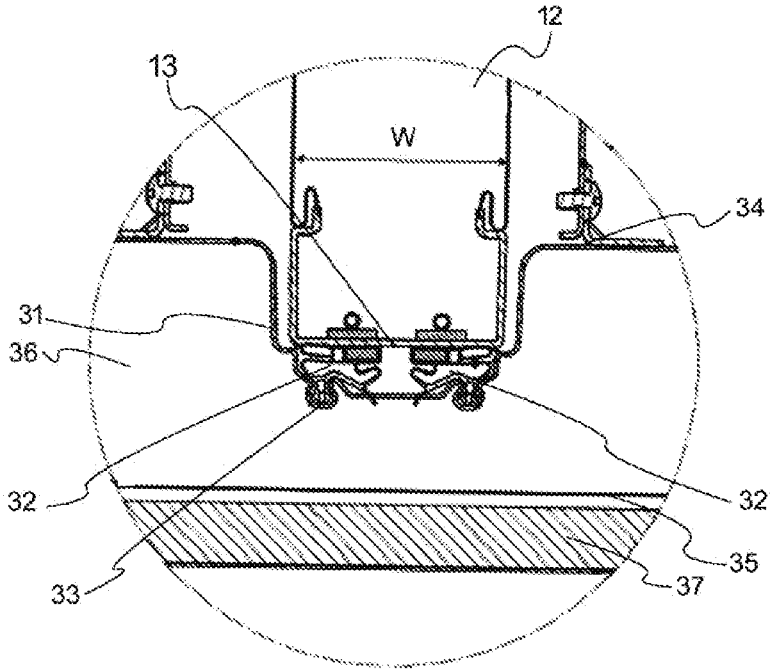
FIG. 4 is a representative, fragmentary, cross-sectional view a portion B of the cooling device according to the invention shown in FIG. 3.
Figure 5:
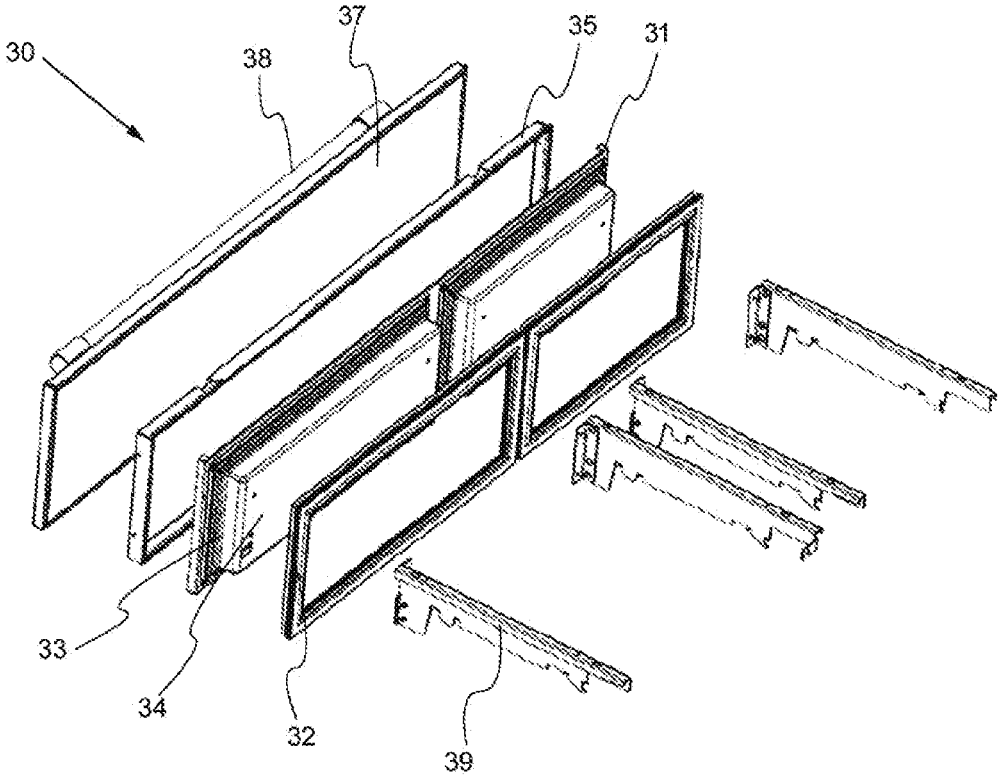
FIG. 5 is a representative, exploded view of the door of the cooling device according to the invention.

With reference to FIGS. 4 and 5, it is seen that the door 30 has at least one inner liner 31 provided on a side facing the storage compartments 20, an outer layer 35 provided in such a way that there is an insulation material 36 between the inner liner 31 and the outer layer 35, and a decorative panel 37 which covers the outer layer 35. A door handle 38 is provided on the decorative panel 37 for holding the door 30 during opening and closing thereof. The inner liner 31 can be provided in a one-piece manner or can be provided in a multiple-piece form, in such a way that there is one piece for each of the storage compartments 20. There is at least one boss or bossing 34 provided on the inner liner 31. The bosses 34 at least partially extend into the respective storage compartment 20 when the door 30 is closed. Each of the bosses 34 are substantially provided in a proportional manner with the dimensions of an inlet opening of the respective storage compartment 20. Thus, the thickness of the part of the door 30 which covers the storage compartment 20 is increased and thus, the amount of the insulation material 36 being used is increased.

There is at least one gasket 32 provided on the side of the inner liner 31 which faces the storage compartment 20. While the gasket 32 is fixed to the inner liner 31 from one side, the gasket 32 rests at a flank part 13 of the body 11 when the door 30 is closed. Thus, thermal insulation is provided between the door 30 and the body 11. The gasket 32 is configured to be attached into at least one gasket channel 33 provided on the inner liner 31. In a possible embodiment of the present invention, the gasket 32 can be provided in a one-piece manner so as to encircle the inlet of at least two storage compartments 20. In another possible embodiment of the present invention, the gasket 32, provided in one-piece form, is configured to press to the flank part 13 provided at the front part of the insulation wall 12 between the storage compartments 20. In another possible embodiment of the present invention, a plurality of gaskets 32 is provided in a manner encircling the inlet of each storage compartment 20. In that embodiment, since there is a door 30 which covers the two storage compartments 20, the need for the distance between the doors 30 in the two-door systems of the prior art is eliminated. Depending on this, it becomes possible to decrease the insulation wall thickness W of the insulation wall 12 provided between the two storage compartments 20. This means that the volumes of the storage compartments 20 can be increased and the insulation wall 12 can be made by using less material. Thus, production costs are reduced.

There are at least two pull-out brackets 39 associated with the door 30 in order for the door 30 to be opened and closed in the form of a drawer. The pull-out brackets 39 are provided at the two sides of the door 30 and are connected to two side walls of the body 11. In another possible embodiment of the present invention, there is one or more additional pull-out brackets 39 connected to the insulation wall 12. In another possible embodiment, there are two pull-out brackets 39 associated with two sides of the insulation wall 12. Accordingly, two, three or four pull-out brackets 39 can be provided according to the size and weight of the door 30 and the carriage capacity of the pull-out bracket 39 which is to be used.

Figure 6:
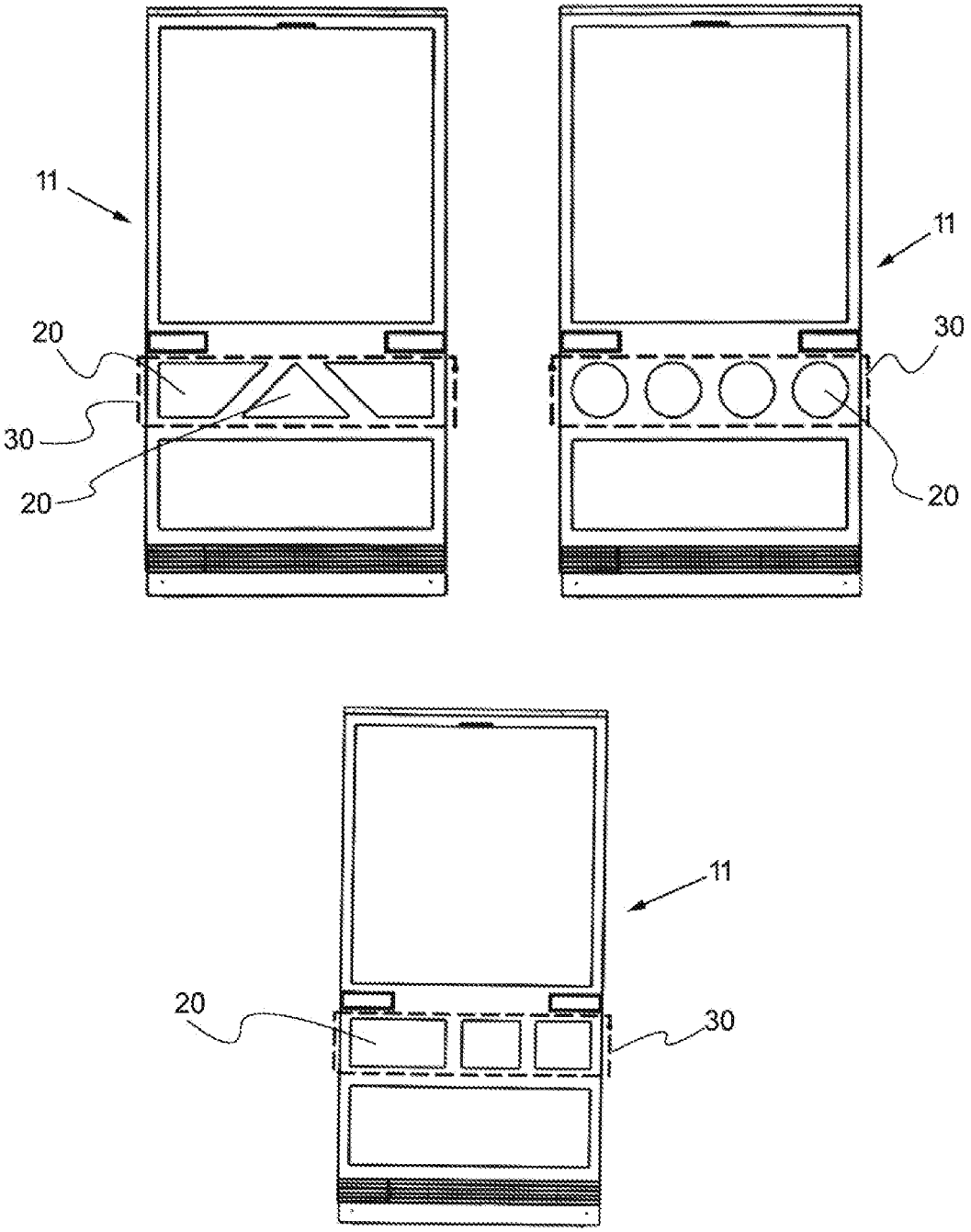
FIG. 6 includes representative, front-elevational views of alternative embodiments of the cooling device according to the invention.

As can be seen in FIG. 6, since the door 30 is provided in a manner covering a plurality of storage compartments 20, structural freedom is also provided for the shapes of the storage compartments 20. Accordingly, the storage compartments 20 can be provided so as to have cross-sections in circle, square, triangle, rectangle or trapezoid forms.

Figure 7:
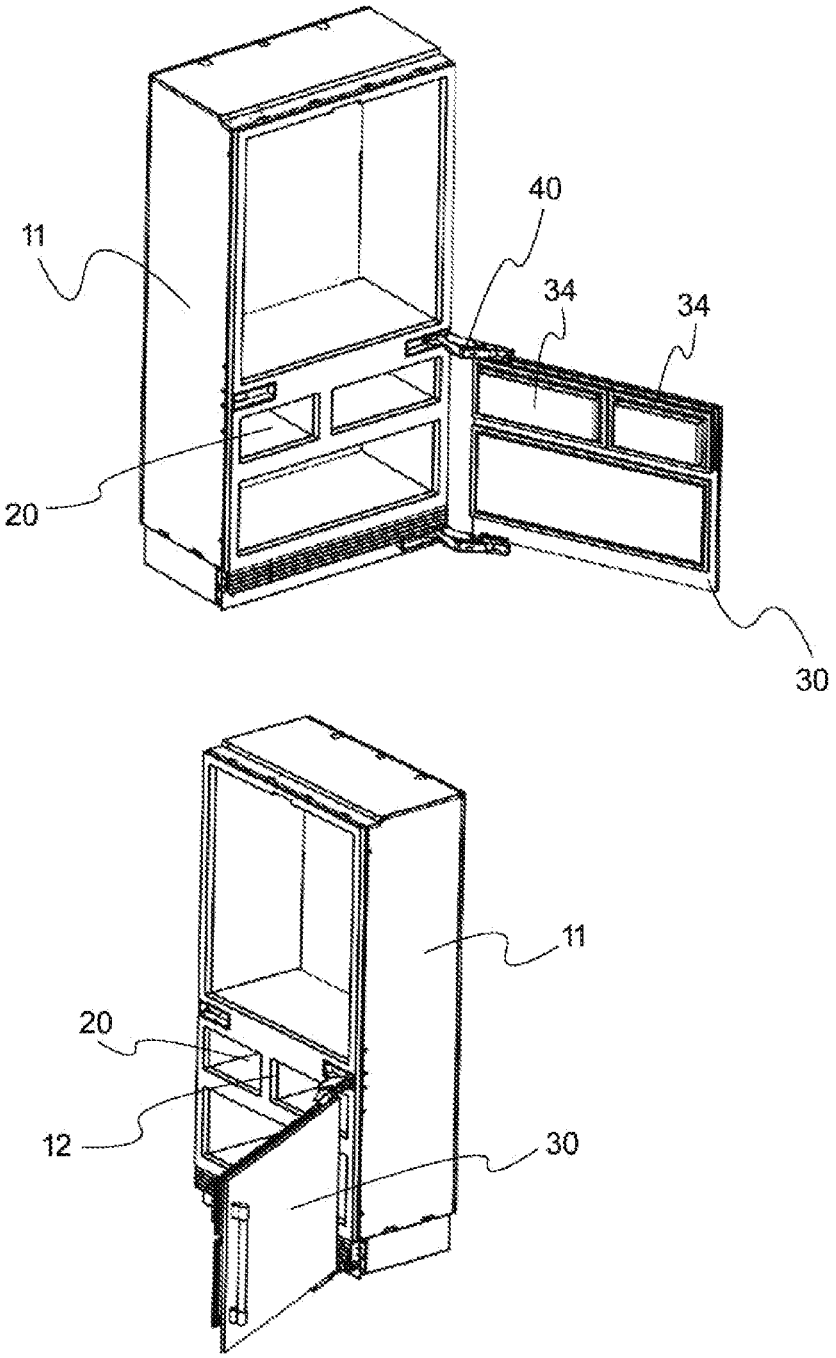
FIG. 7 includes representative, perspective views of another possible embodiment of the cooling device according to the invention.

As can be seen in FIG. 7, the door 30 can also be provided in the form of a traditional door which can be connected to the body 11 by a hinge 40 and which can be opened and closed.

Figure 8:
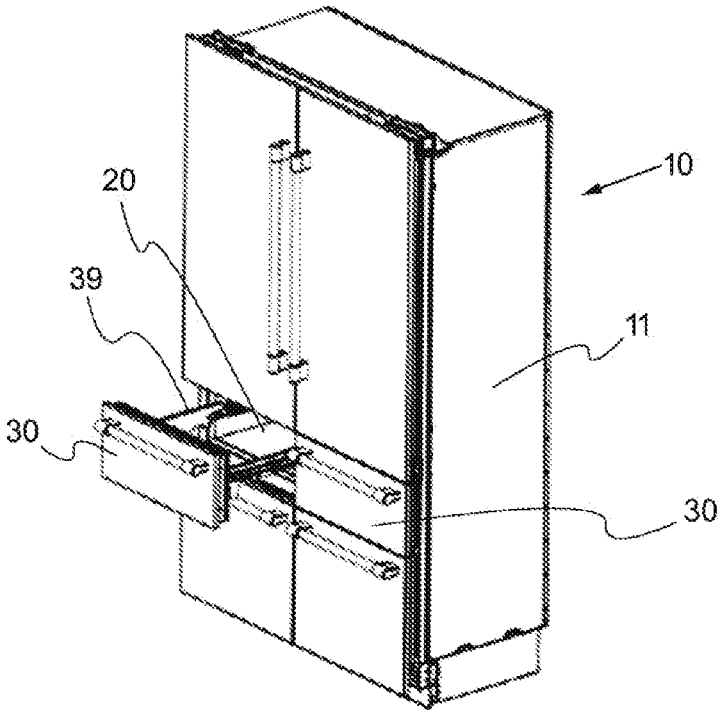
Fig.8 (Prior Art)
FIG. 8 is a representative, perspective view of a cooling device known in the prior art.
Figure 9:
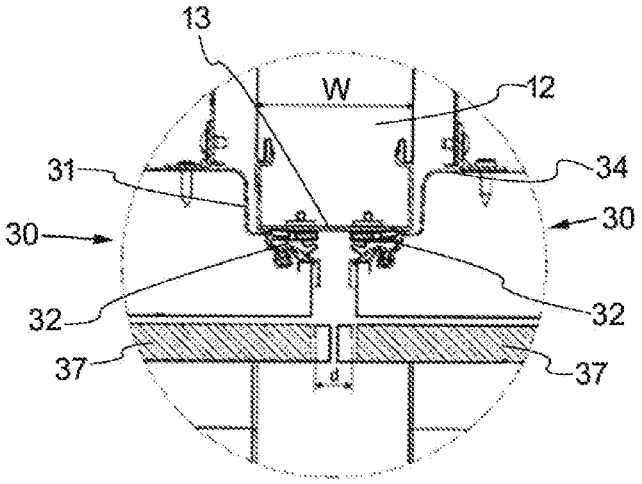
Fig.9 (Prior Art)
FIG. 9 is a representative, fragmentary, cross-sectional view of the cooling device known in the prior art.

In the prior art cooling device shown in FIGS. 8 and 9, two doors 30 each having a decorative panel 37 and being spaced apart by a distance d, are provided for two storage compartments 20.

The following is a summary list of reference numerals and the corresponding structure used in the above description of the invention:

10 Cooling device
11 Body
12 Insulation wall
13 Flank part
20 Storage compartment
30 Door
31 Inner liner
32 Gasket
33 Gasket channel
34 Bossing
35 Outer layer
36 Insulation material
37 Decorative panel
38 Door handle
39 Pull-out bracket
40 Hinge d Distance W Insulation wall thickness

The invention claimed is:

1. A cooling device, comprising:

a body having a flank part;

at least two storage compartments disposed in said body, each of said at least two storage compartments having a respective inlet;

at least one insulation wall disposed between said at least two storage compartments; and a door facing and associated with said flank part of said body, said door being configured to close said inlets of said at least two storage compartments;

said door includes at least two bosses extending inward toward said at least two storage compartments when said door is closed, said two bosses defining a channel in said door, said channel receiving said insulation wall therein.

2. The cooling device according to claim 1, wherein said door has at least one gasket encircling at least one of said storage compartments and resting against said flank part.

3. The cooling device according to claim 2, wherein said door has an inner liner facing said flank part, and said at least one gasket is provided on said inner liner.

4. The cooling device according to claim 3, which further comprises at least one gasket channel disposed on said inner liner, said at least one gasket being configured to be attached at said at least one gasket channel.

5. The cooling device according to claim 1, wherein said door has an inner liner facing said flank part, and said at least two bosses are integrated on said inner liner.

6. The cooling device according to claim 1, wherein each of said bosses are compliant to a shape of a respective one of said at least two storage compartments.

7. The cooling device according to claim 1, wherein each of said bosses has dimensions substantially close to dimensions of an inlet opening of a respective one of said at least two storage compartment.

8. The cooling device according to claim 1, wherein said door includes a decorative panel covering said at least two storage compartments.

9. The cooling device according to claim 1, wherein said door includes at least two pull-out brackets connected to side walls of said body.

10. The cooling device according to claim 9, wherein said door includes one or more further pull-out brackets connected to said insulation wall.

11. The cooling device according to claim 9, further comprising respective seals disposed on a base of said channel for each of said bosses.

12. The cooling device according to claim 9, wherein said bosses overlap said insulation wall in a depth direction of the cooling device.

* * * * *